United States Patent [19]

Grammatico

[11] Patent Number: 4,902,017

[45] Date of Patent: Feb. 20, 1990

[54] WAR SIMULATION BOARD GAME

[76] Inventor: John Grammatico, 1836 Bolker Pl., San Pedro, Calif. 90731

[21] Appl. No.: 377,335

[22] Filed: Jul. 10, 1989

[51] Int. Cl.[4] ..... A63F 3/00

[52] U.S. Cl. ..... 273/240; 273/1 G; 273/255

[58] Field of Search ..... 273/1 G, 1 GI, 240, 273/245, 255, 262, 409

[56] References Cited

U.S. PATENT DOCUMENTS

| | | | |
|---|---|---|---|
| 690,656 | 1/1902 | Lasker | 273/240 |
| 1,396,073 | 11/1921 | St. Pierre | 273/409 |
| 2,313,303 | 3/1943 | Szatrow | 273/262 |
| 3,811,679 | 5/1974 | Benge | 273/262 |
| 3,998,463 | 12/1976 | Zumchak | 273/262 |
| 4,093,236 | 6/1978 | Hoffa | 273/255 |
| 4,373,731 | 2/1983 | Whiteman et al. | 273/262 |

OTHER PUBLICATIONS

"Play Golf: A Game for Everyone", place mat produced by Molanco East.

*Primary Examiner*—Edward M. Coven
*Assistant Examiner*—Benjamin Layno
*Attorney, Agent, or Firm*—Jerry T. Kearns

[57] ABSTRACT

A war simulation board game utilizes a playing board having a grid pattern of square segments, each square having a centrally located circular target zone. Game pieces simulating war vehicles move on the grid pattern according to a spinner. Opposing players "fire" on each other's game pieces and headquarter zones by placing the tip of an ink marker on a target zone of a square occupied by one of their game pieces and orienting the marker in a vertical position, supported by an index finger contacting a butt end portion of the marker. The player then applies an external force to the marker forcing the marker tip to freely slide away from the target zone and forcing the marker to leave contact with the player's index finger as it falls in an arcuate motion. The sliding marker tip forms an ink line segment simulating a projectile shot path on the board surface. If the resulting ink line segment passes through a target zone of a square occupied by an opposing game piece, the "shot" is scored as a hit. At opposite ends of the game board are chance result cards which are placed face down. One of the chance result cards at each end of the board simulates a military headquarters, while the remaining cards simulate hidden bombs. Players attempt to find and destroy the opponent's headquarters.

20 Claims, 4 Drawing Sheets

WAR SIMULATION BOARD GAME

BACKGROUND OF THE INVENTION

1. Field of the Invention

The present invention relates to war simulation board games, and more particularly pertains to a war board game which combines skill in the form of manual dexterity and also strategy along with random chance to provide an exciting and entertaining board game.

2. Description of the Prior Art

Various types of war simulation board games are known in the prior art. A typical example of such a game is to be found in U.S. Pat. No. 2,313,303, which issued to M. Szatrow on game board having a grid pattern and indicia representing land and sea areas. Game pieces simulating war ships are moved about the game board in accordance with predetermined movement patterns. U.S. Pat. No. 3,811,679, which issued to D. Benge on May 21, 1974, discloses a warfare game utilizing a game board having a plurality of zones and movement paths connecting the zones designated thereon. Indicia representing land and sea areas is also provided. A variety of game pieces simulating war vehicles and soldiers are moved about the game board in accordance with predetermined movement patterns. U.S. Pat. No. 3,998,463, which issued to J. Zumchak on Dec. 21, 1976, discloses a naval combat simulating board game which utilizes a generally checker board configured game board and a plurality of game pieces simulating war ships and planes. U.S. Pat. No. 4,093,236, which issued to R. Hoffa on June 6, 1978, discloses a war game which utilizes a game board having indicia representing various geographic regions and geomorphic segments designating various different terrains. Game pieces simulating war vehicles are moved about the game board in accordance with predetermined rules. Weapon firing is simulated by throwing dice and evaluating the results in accordance with weapon capacity charts. U.S. Pat. No. 4,373,731, which issued to D. Whiteman et al on Feb. 15, 1983, disclose a war simulation board game which utilizes a game board having a grid pattern formed by a plurality of square segments and including indicia representing land and sea area. Game pieces are moved about the game board in accordance with results determined by a random number generator. Weapon fire is simulated by throwing dice.

While the above mentioned devices are directed to war simulation board games, none of these devices disclose a game which utilize the fall of a writing instrument to simulate weapon firing by forming a simulated projectile shot path between target zones of occupied segments. The previously described prior art devices typically utilize predetermined rules and random number generators such as dice to simulate weapon firing. This adds an undue element of chance which negates any opportunity for the development of player skill. The excessive random play factor of the prior art games removes much of the elements of direct skill competition which attracts and entertains typical game players Inasmuch as the art is relatively crowded with respect to these various types of war simulation board games, it can be appreciated that there is a continuing need for and interest in improvements to such war simulation board games, and in this respect, the present invention addresses this need and interest.

SUMMARY OF THE INVENTION

In view of the foregoing disadvantages inherent in the known types of war simulation board games now present in the prior art, the present invention provides an improved war simulation board game. As such, the general purpose of the present invention, which will be described subsequently in greater detail, is to provide a new and improved war simulation board game which has all the advantages of the prior art war simulation board games and none of the disadvantages.

To attain this, a representative embodiment of the concepts of the present invention is illustrated in the drawings and makes use of a war simulation board game including a playing board having a grid pattern formed by a plurality of square segments, each of the squares having a target zone formed by a circle centrally located in the square. Indicia designates land and sea areas on the playing board and two sets of opposing game pieces are provided for movement on the grid pattern. The game pieces are preferably formed to simulate war vehicles such as ships and planes. Movement of the game pieces on the playing board is determined by a random number generating spinner. Opposing game players "fire" on each other's game pieces and headquarter zones by placing the tip of an ink marker on a target zone of a square occupied by one of their game pieces and orienting the marker in a vertical position, supported by an index finger contacting a butt end portion of the marker. The player then forms a simulated projectile shot path on the game board surface by releasing the marker and allowing it to fall by gravity. If the resulting ink line segment passes through a target zone of a square occupied by an opposing game piece, the "shot" is scored as a hit. Capture zones are defined at opposite ends of the game board and are associated with a set of chance result cards which are placed face down to hide the indicia thereon. One of the chance result cards at each end of the board simulates a military headquarters, while the remaining cards simulate hidden bombs. Players attempt to find and destroy the opponent's headquarters.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved war simulation board game which has all the advantages of the prior art war simulation board games and none of the disadvantages.

It is another object of the present invention to provide a new and improved war simulation board game which may be easily and efficiently manufactured and marketed.

It is a further object of the present invention to provide a new and improved war simulation board game which is of a durable and reliable construction.

An even further object of the present invention is to provide a new and improved war simulation board game which is susceptible of a low cost of manufacture with regard to both materials and labor, and which accordingly is then susceptible of low prices of sale to the consuming public, thereby making such war simulation board games economically available to the buying public.

Still yet another object of the present invention is to provide a new and improved war simulation board game which provides in the apparatuses and methods of the prior art some of the advantages thereof, while simultaneously overcoming some of the disadvantages normally associated therewith.

Still another object of the present invention is to provide a new and improved war simulation board game which combines player manual dexterity skill, player strategy skill and a random chance element to determine the course of game play.

Yet another object of the present invention is to provide a new and improved war simulation board game which utilizes a method of simulating weapon firing which allows the development and influence of player skill in determining the results achieved.

Even still another object of the present invention is to provide a new and improved war simulation board game which utilizes the fall of a writing implement to form indicia representing a simulated projectile shot path line on a game board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
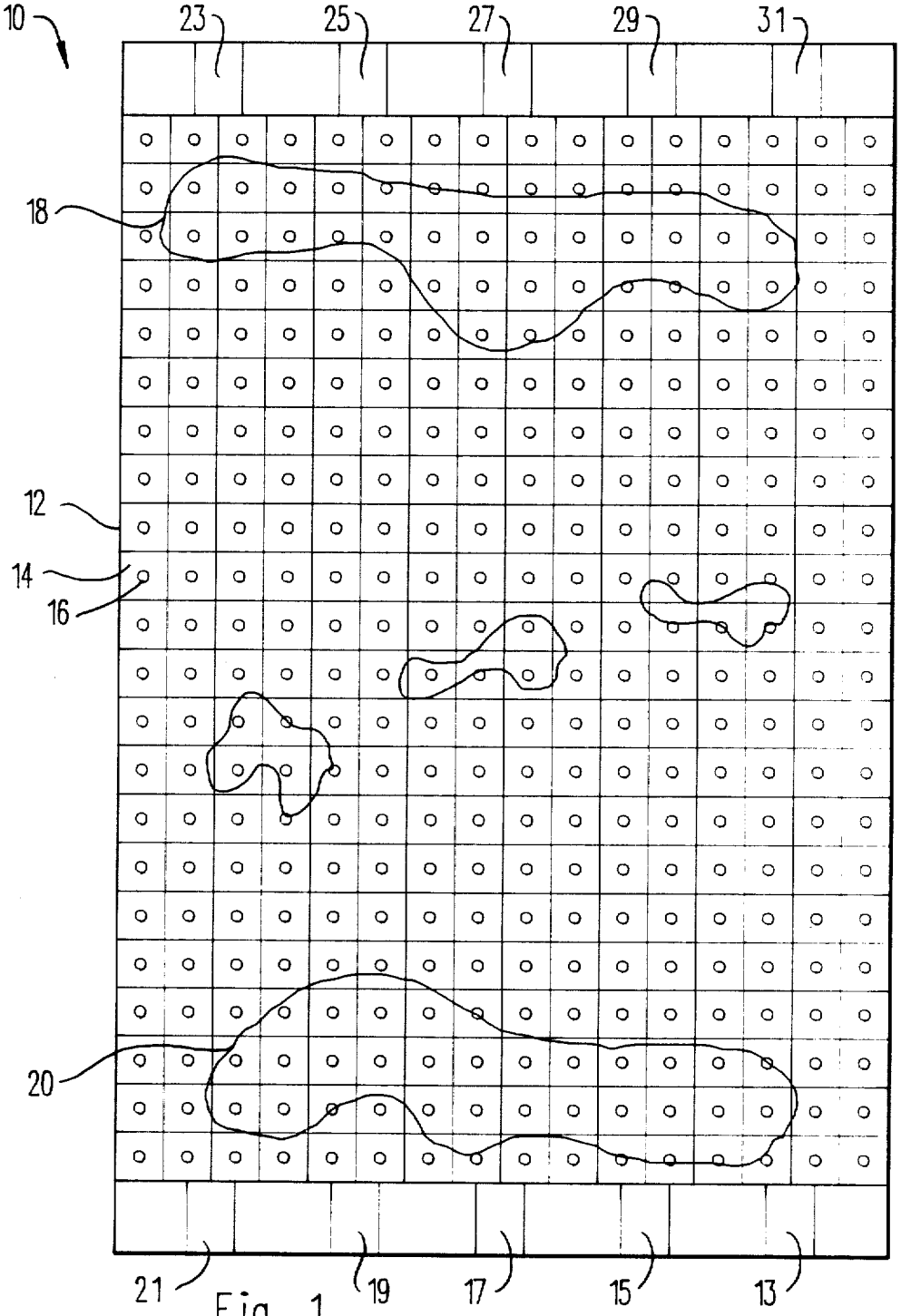
FIG. 1 is a plan view illustrating the game board utilized in the play of the game of the present invention.

With reference now to the drawings, and in particular to FIG. 1 thereof, a new and improved war simulation board game embodying the principles and concepts of the present invention and generally designated by the reference numeral 10 will be described.

More specifically, it will be noted that the first embodiment 10 of the invention includes a rectangular game board 12 having a top face imprinted with a grid pattern formed by a plurality of squares 14. Each of the squares 14 has a target zone defined by a circle 16 located centrally within each of the square segments 14. Opposing land areas 18 and 20 are designated by imprinted indicia on the game board 12. A plurality of capture zone segments are defined at each of the two opposite ends of the game board 12. The target zone on each of the capture segments is identified by a cross-hair pattern and is disposed adjacent one of the chance result card stations 13, 15, 17, 19, 21, 23, 25, 27, 29 and 31. The capture segments may be designated by other forms of indicia or by color shading. It is contemplated that the circles of the target zones in each of the specially designated capture segments will be slightly small than the target zones 16 of the remaining segments 14 of the game board 12. This makes the capture segments more difficult to hit with simulated weapon fire.

Figure 2:
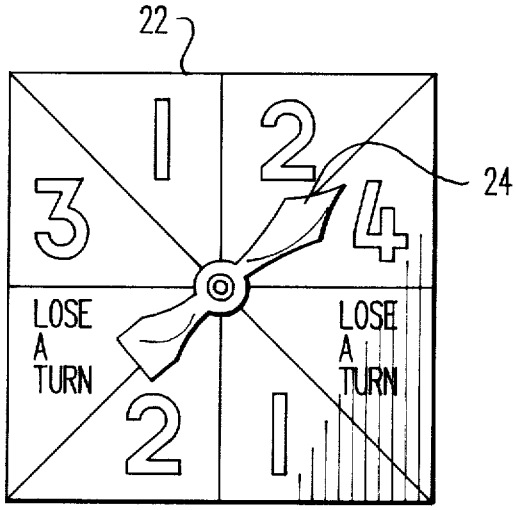
FIG. 2 is a plan view illustrating a random number generating spinner utilized in the play of the game of the present invention.

FIG. 2 illustrates a random chance spinner 22 having a rotationally mounted indicating pointer 24 which is utilized to determine the length of game piece movement on the game board 12.

Figure 3:
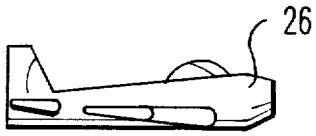
FIG. 3 is a side elevational view illustrating a war plane game piece.

FIG. 3 illustrates an example form of playing piece 26 which is formed to simulate a war plane.

Figure 4:
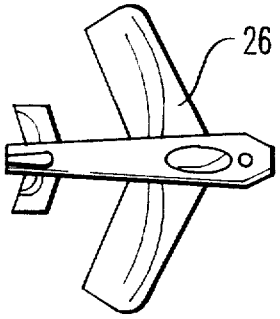
FIG. 4 is a top plan view of the war plane game playing piece of FIG. 3.

FIG. 4 is a top plan view of the game piece 26.

Figure 5:
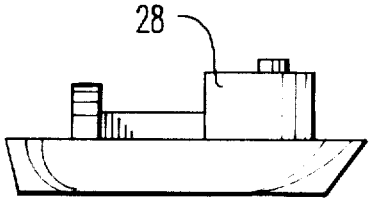
FIG. 5 is a side elevational view illustrating a war ship game playing piece.

FIG. 5 illustrates a war ship simulating game piece 28.

Figure 6:
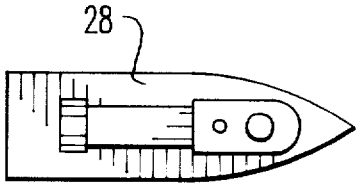
FIG. 6 is a top plan view illustrating the war ship game playing piece of FIG. 5.

FIG. 6 is a top plan view of the war ship game piece 28.

Figure 7:
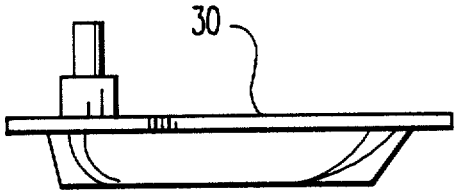
FIG. 7 is a side elevational view illustrating an aircraft carrier game playing piece.

FIG. 7 is a side view illustrating an aircraft carrier simulating game piece 30.

Figure 8:
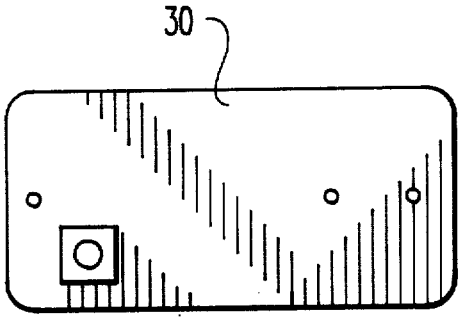
FIG. 8 is a top plan view of the aircraft carrier playing piece of FIG. 7.

FIG. 8 is a top plan view of the aircraft carrier simulating game piece 30.

Figure 9:
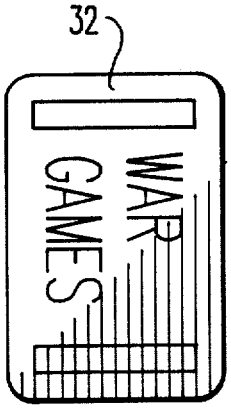
FIG. 9 illustrates the back face of a chance result card utilized in the play of the game of the present invention.

FIG. 9 illustrates the back face of a sample chance result card 32. Each of the chance result cards utilized have identical back faces such that they may be placed face down to hide the relevant indicia on the front face thereof.

Figure 10:
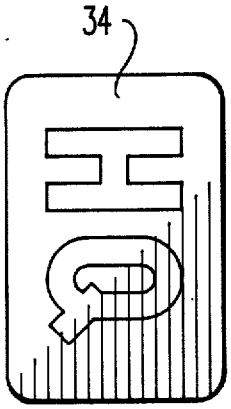
FIG. 10 illustrates a front face of a headquarters "CHANCE RESULT CARD".

FIG. 10 illustrates the front face of a HEADQUARTERS type chance result card 34. Each player is initially provided with a single HEADQUARTERS card 34 to simulate their military headquarters.

Figure 11:
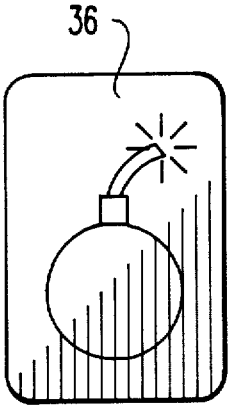
FIG. 11 illustrates the front face of a bomb "CHANCE RESULT CARD".

FIG. 11 illustrates the front face of a BOMB type chance result card 36. Each player is provided with a plurality of BOMB cards 36.

Figure 12:
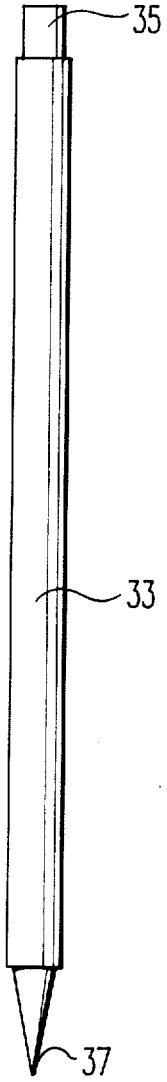
FIG. 12 is a side elevational view illustrating a writing implement utilized to simulate fire weapon firing in the play of the game of the present invention.

FIG. 12 illustrates a writing implement 33 having an operative tip portion 37 and a butt end portion 35. The writing implement 33 is preferably in the form of an ink marker and is utilized to simulate weapon firing on the game board.

Figure 13:
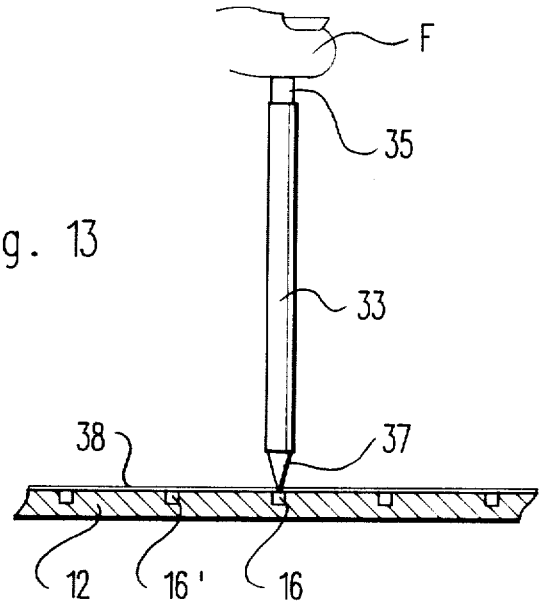
FIG. 13 is a side elevational view, partially in cross section, illustrating the use of the writing implement to simulate weapon firing.
Figure 14:
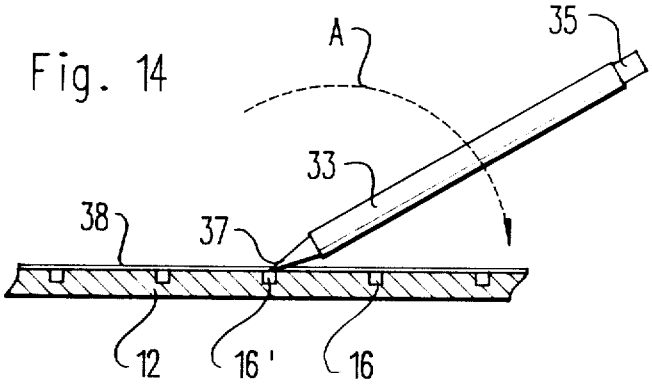
FIG. 14 is a side elevational view further illustrating the method of simulating weapon firing in the play of the game of the present invention.

FIG. 13 illustrates the manner of simulating weapon firing utilizing the ink marker 33. The upper surface of the game board 12 is preferably covered by a transparent plastic laminate layer 38 which provides an easily cleanable writing medium for the marker 33. To simulate firing between a game board square segment occupied by a friendly game piece and a game board segment occupied by an opposing game piece, the player initially positions the marker 33 in a generally vertical orientation with the tip 37 overlying the circular target zone 16 of the friendly game board segment and supports the marker 33 by contact of the player's forefinger F with the butt end portion 35. The friendly target zone is indicated at 16 and the opposing target zone to be fired upon is indicated at 16 . As shown in FIG. 14, the player applies an external force to marker 33 forcing the tip 37 to slide from target zone 16 to the opposing target zone 16' while falling in an arcuate motion as indicated at A. The external force can be applied in different ways such as, continually applying pressure with the player's index finer F against butt end 35 while tilting the marker in an arcuate motion, as indicated at A, until the tip 37 slides away, or flicking the bottom portion of the marker with the player's other hand forcing the tip 35 to slide away. Friction between the sliding tip 35 and board surface 38 causes the tip 37 to draw a line segment between the friendly target zone 16 and the opposing target zone 16'. If the resulting line segment passes through both of the target zones 16 and 16', the "shot" is a hit. If the line segment does not pass through the target zones 16 and 16', the "shot" is a miss. After firing, the ink line segment may be erased using a damp cloth or tissue.

With reference now to the various Figures, the manner of play of the game of the present invention will now be described. To start the game, each of two opposing players initially line their war ship playing pieces 28 and 30, respectively illustrated in FIGS. 5 and 7 along the coast of their respective islands 18 and 20. The players war plane game pieces 26 are initially positioned anywhere on their respective island 18 or 20. It should be noted that the total number and the number of each type of game playing pieces may be varied in accordance with the corresponding playing board dimensions and individual tastes, without departing from the scope of the present invention. The players then secretly position their HEADQUARTERS card 34 shown in FIG. 10, in one of the card stations 13, 15, 17, 19, 21, 23, 25, 27, 29 and 31 located adjacent their end of the board 12. The remaining card stations at their end of the board 12 each receive a BOMB card 36 as shown in FIG. 11. This set up process is done secretly to hide the location of their military headquarters. The players then initially spin the random number generator 22 illustrated in FIG. 2 to determine the initial order of play. The player that spins the highest number moves first. If there is a tie, the players then spin again to break the tie. When the order of play is thus determined, the initial player again spins the spinner 22 to determine the number of square segments 14 which he may traverse on the game board 12. The player can move his game pieces in any direction except diagonally between the squares 14. The number determined by the spinner 22 may be divided between game pieces, or may be moved by a single piece. For example, if a player spins a "4", he may move 4 game pieces each one square, or he can optionally elect to move 1 game piece a distance of 4 squares. Play proceeds in this manner sequentially until opposing game pieces get close enough for a player to take a "shot" at an opposing game piece. As previously described with respect to FIGS. 13 and 14, when taking a shot, the player positions the point 37 of the marker 33 on the target zone circle 16 of the square segment occupied by a friendly game piece and aims toward the target zone 16' on a segment 14 occupied by an opposing game piece. The marker is supported in a vertical position by the player's forefinger F on the butt end portion 35 of the marker 33 and the player exerts downward pressure on the friendly target zone 16. The player then allows the marker 33 to slip and fall toward the opponent's target zone 16'. If the resulting line segment produced by the marker goes through the opponent's target zone 16', it is a hit and the opponent's game piece is removed from the game. If the line segment does not go through the opponent's target zone circle 16', the shot is a miss and the opponent now has the choice of taking a shot in return or moving closer for a better shot. The specially designated capture zone segments adjacent the card stations 13, 15, 17, 19, 21, 23, 25, 27, 29 and 31 may be fired upon by the respective opposing player in an attempt to locate the enemy headquarters card 34 as shown in FIG. 10. If a player fires upon and hits one of the specially designated capture zone target circles, the corresponding chance result card is overturned. If the card is a bomb card 36 as shown in FIG. 11, the firing player's game piece is destroyed and is removed from the game. On the other hand, if the headquarter card 34 is revealed, the firing player has destroyed the enemy's military headquarters and wins the game. As may now be understood, the present invention entails strategy elements in selecting movement of the game pieces about the game board 12, manual dexterity skills in firing on opponent's game pieces and also an element of chance in determining movement length.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A war simulation board game, comprising:
a playing board having a grid pattern formed by a plurality of segments;
indicia identifying a target zone on each of said segments;
at least two opposing game pieces for movement on said grid;
and
a writing implement for determining simulated projectile path lines on said playing board between said target zones.

2. The war simulation board game of claim 1, further comprising indicia on said playing board identifying land and sea areas.

3. The war simulation board game of claim 1, further comprising a transparent upper layer on said playing board forming an easily cleanable writing medium for said writing implement.

4. The war simulation board game of claim 1, wherein said writing implement comprises an ink marker.

5. The war simulation board game of claim 1, wherein said game pieces simulate war vehicles.

6. The war simulation board game of claim 1, wherein said game pieces comprise simulated war ships and planes.

7. The war simulation board game of claim 1, wherein said playing board segments comprise squares and said target zone comprise circles centrally located in said squares.

8. The war simulation board game of claim 1, further comprising random number generating means for determining movement of said game pieces on said playing board.

9. The war simulation board game of claim 1, further comprising a plurality of capture zone segments defined at opposite ends of said playing board and respective chance result cards associated with each of said capture zones.

10. The war simulation board game of claim 9, wherein said chance result cards comprise a set of cards for each opposing player, each of said card sets including a plurality of cards bearing indicia representing a bomb and a single card bearing indicia representing a military headquarters, with each of said chance result cards having a plain identical back face.

11. A method of playing a war simulation board game, comprising the steps of:
providing:
a playing board having a grid pattern formed by a plurality of segments;
indicia identifying a target zone on each of said segments;
at least two opposing game pieces for movement on said grid;
an elongated writing implement having an operative tip portion and an opposite butt portion;
sequentially moving said game pieces on said segments by game players;
and
selectively simulating firing at opposing game pieces by placing said tip portion of said writing implement on a target zone of one of said segments, standing said writing implement in a generally vertical position supported solely by player contact with said butt portion applying an external force to said writing implement forcing said tip portion to slide freely away from said target zone and thereby causing the release of player contact with said butt portion, friction between said sliding tip portion and playing board surface forming a simulated projectile shot path indicia on said playing board toward a target zone of a segment occupied by an opposing game piece.

12. The method of claim 11, further comprising the step of providing indicia representing land and sea zones on said playing board.

13. The method of claim 11, further comprising the step of providing a transparent upper layer on said playing board forming an easily cleanable writing medium for said writing implement.

14. The method of claim 11, further comprising the step of providing an ink marker as said writing implement.

15. The method of claim 11, further comprising the step of forming said game pieces to simulate war vehicles.

16. The method of claim 11, further comprising the step of forming said game pieces to simulate war ships and planes.

17. The method of claim 11, further comprising the step of forming said playing board segments as squares and forming said target zones as circles centrally located in said squares.

18. The method of claim 11, further comprising the steps of providing random number generating means and moving said game pieces on said playing board in accordance with said random number generating means.

19. The method of claim 11, further comprising the steps of:
providing a plurality of capture zone segments at opposite ends of said playing board;
associating a plurality of chance result cards with said capture zones;
and
moving said game pieces to attack and fire on said capture zones.

20. The method of claim 19, further comprising the steps of:
providing indicia representing a bomb on all but one of said chance result cards at each end of said playing board;
providing indicia representing a military headquarters on one of said chance result cards at each end of said playing board;
and
placing each of said chance result cards face down to hide said indicia.

* * * * *